United States Patent [19]

Knödler

[11] 4,251,774

[45] Feb. 17, 1981

[54] INTERNAL COMBUSTION ENGINE IGNITION SYSTEM TEST APPARATUS

[75] Inventor: Jürgen Knödler, Remshalden-Grunbach, Fed. Rep. of Germany

[73] Assignee: Robert Bosch GmbH, Stuttgart, Fed. Rep. of Germany

[21] Appl. No.: 10,815

[22] Filed: Feb. 9, 1979

Related U.S. Application Data

[63] Continuation-in-part of Ser. No. 820,844, Aug. 1, 1977, abandoned.

[30] Foreign Application Priority Data

Aug. 14, 1976 [DE] Fed. Rep. of Germany ..... 2636677

[51] Int. Cl.[3] ..... F02P 17/00

[52] U.S. Cl. ..... 324/384; 324/169; 324/386; 324/392

[58] Field of Search ..... 324/384, 386, 392, 169

[56] References Cited

U.S. PATENT DOCUMENTS

| | | | |
|---|---|---|---|
| 3,594,634 | 7/1971 | Muller et al. | 324/384 X |
| 3,955,135 | 5/1976 | Fastaia | 324/384 |
| 3,956,691 | 5/1976 | Hryhorczuk et al. | 324/384 |
| 3,986,009 | 10/1976 | Fastaia | 324/392 X |
| 4,109,195 | 8/1978 | Palmer | 324/384 X |

*Primary Examiner*—Stanley T. Krawczewicz

*Attorney, Agent, or Firm*—Frishauf, Holtz, Goodman & Woodward

[57] ABSTRACT

To permit tests of: ignition timing; dwell angle; engine speed; and voltage levels, a pulse train is provided derived from the ignition system of the engine; the pulse train is applied to a frequency multiplier, preferably a phase locked loop (PLL) which provides a sequence of output pulses having a pulse repetition rate which is a multiple of the frequency of the signals or pulses of the pulse train. An AND gate has the multiplied signals applied thereto and is enabled, selectively, in accordance with the desired test. The output of the AND gate is applied to a counter which counts multiplied pulses within the interval of enabling of the AND gate, the output being applied to a digital indicator to provide a direct readable digital output; preferably, the multiplication rate is selected to provide a digital output indication which is directly readable in desired units. To determine dwell angle, enabling pulses are applied to the AND gate from the ignition system; to determine spark timing, derived enabling pulses are applied to the AND gate, derived from the ignition system upon being compared with a reference signal, for example an upper dead center (TDC) signal; to determine speed, the enabling pulses are applied with respect to a clock reference; and to determine a voltage test level, the input to the system is disconnected and the test voltage applied to a voltage controlled oscillator of the PLL.

18 Claims, 10 Drawing Figures

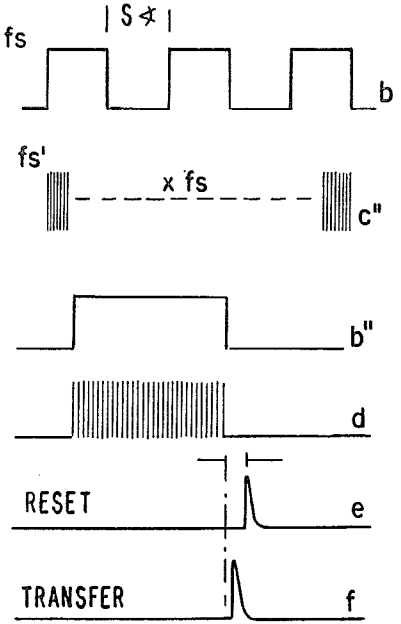
FIG. 6b
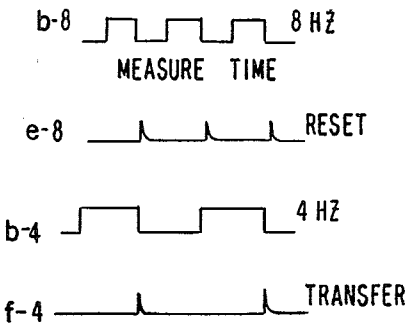
FIG. 6c
FIG. 6a
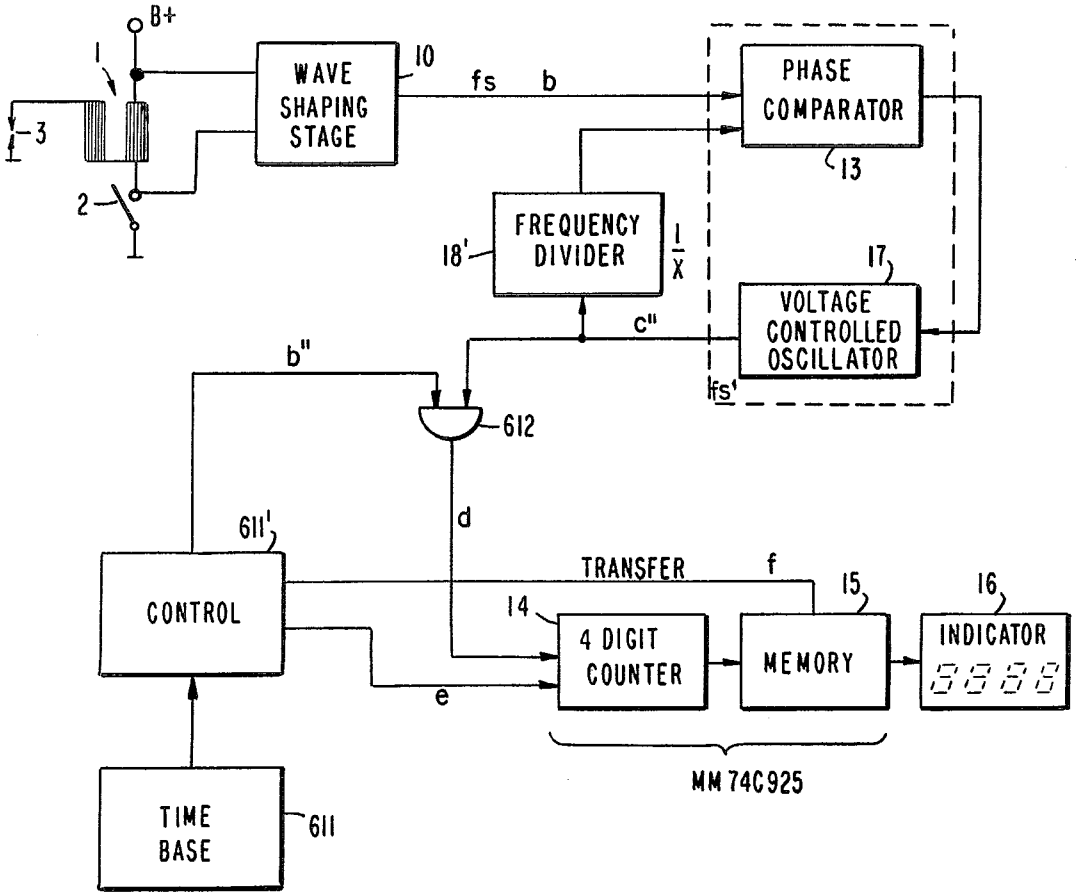

INTERNAL COMBUSTION ENGINE IGNITION SYSTEM TEST APPARATUS

This application is a Continuation-in-Part of prior application Ser. No. 820,844, filed Aug. 1, 1977, now abandoned.

The present invention relates to a test apparatus and system for internal combustion engines, for example automotive-type internal combustion engines, and more particularly to test the ignition system and related systems of externally ignited internal combustion engines.

BACKGROUND AND PRIOR ART

It has previously been proposed to provide a digital computer system to determine the ignition angle, that is, the angle of crankshaft position with respect to a reference, typically the top dead center (TDC) position of the piston, see, for example, German published patent application DT AS No. 23 23 661. This system is suitable only to determine the firing angle, that is, spark advance, and requires a relatively complicated computer system in order to compute the firing angle.

Many measuring and test apparatus have been proposed to determine typical operating data in internal combustion engines; these other test apparatus and systems operate on analog bases. To obtain a digital output, analog-digital (A/D) converters are used. The output values, if indicated as analog values, frequently result in reading errors. The provision of additional A/D converters introduces quantitizing and truncating errors and additionally increases the costs of the overall system since the A/D converters are an additional cost factor for the overall system which operates on an analog basis.

THE INVENTION

It is an object of the present invention to provide a digital-output test apparatus for internal combustion (IC) engines which is simple, provides for direct reading, and operates entirely digitally.

Briefly, a sequence of signals, preferably a pulse train, is applied to an AND gate. A further input of the AND gate is connected to a frequency multiplier circuit also connected to the signal pulse train derived from the ignition systen itself. The output of the AND gate, which will pass the multiplied pulses when enabled, is applied to a counter which counts the multiplied pulses during the interval of occurrence of enabling pulses or signals of the pulse train. The output of the counter is applied to a digital indicator which then will provide, in direct digitally readable quantity, a value which is representative of the characteristics of the enabling of the AND gate.

The pulse train can be connected directly to the ignition system and to the AND gate to provide an output indication representative of dwell angle. Dwell angle is that angle of rotation of the crankshaft of an internal combustion engine during which the breaker switch of the ignition system is closed. Change in the dwell angle changes the operating conditions of the ignition system, and hence changes the operation of the IC engine. Determination of dwell angle is necessary in troubleshooting, for maintenance, tune-ups, and in diagnosis if there should be engine malfunction. The dwell angle must be accurately adjusted for proper operation, and testing of the dwell angle of the distributor-breaker system is frequently necessary.

To obtain an output representative of ignition timing, for example spark advance, the ignition signal is applied to a comparator, the other input to which is a piston reference signal, for example derived from a transducer, and representative, e.g. of top dead center (TDC) position of a piston. An ignition timing pulse is thus obtained and applied to the AND gate as the enabling pulse so that the digital read-out can provide a direct indication of spark advance angle.

Additional tests can be made with the apparatus; for example, if the frequency multiplier includes a phase locked loop (PPL) which includes a voltage controlled oscillator (VCO) then, disconnecting the pulses from the ignition system and applying a test voltage, e.g. battery voltage, to the VCO will provide, at the output indicator, a digital value representative of the test voltage. If the ignition signal, as derived from the frequency multiplier, is applied for a predetermined time period, as determined by a reference clock signal, the output will be representative of engine speed.

The apparatus permits different digital measurements by means of simple changes of switches at few, and readily accessible junction points so that the apparatus and system will be highly versatile.

The signals are processed in the apparatus in digital form and digitally indicated. It can readily be constructed by use of commercial integrated circuits, so that it can be inexpensively built.

Drawings, illustrating an example:

Figure 1:
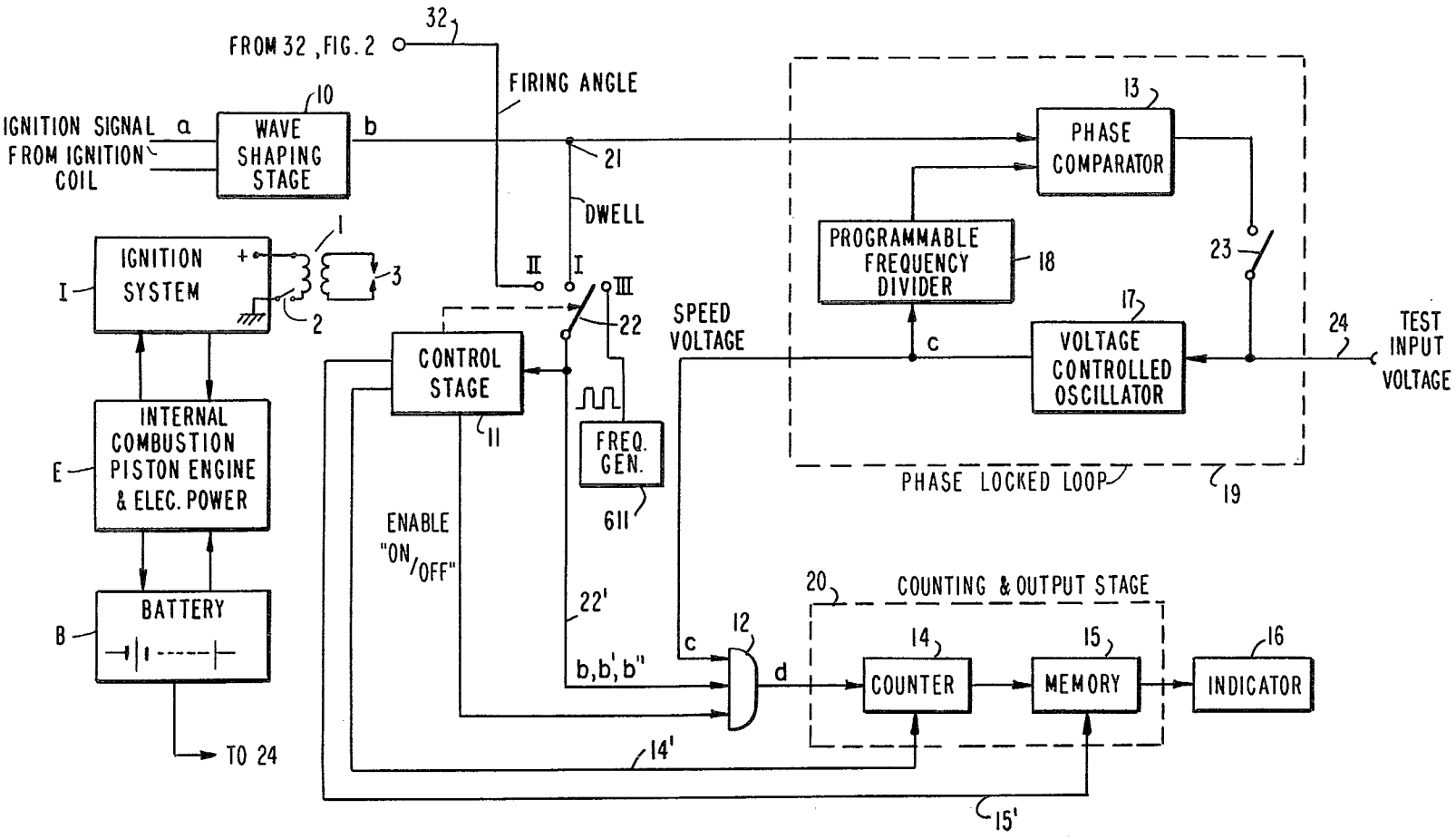
FIG. 1 is a schematic block diagram illustrating the system and the apparatus in which the letters adjacent the signal lines carry the signals shown in the equally lettered graphs of FIG. 3.
Figure 4B:
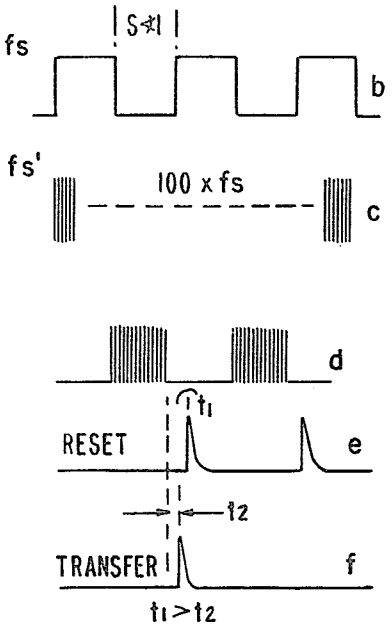
Figure 4A:
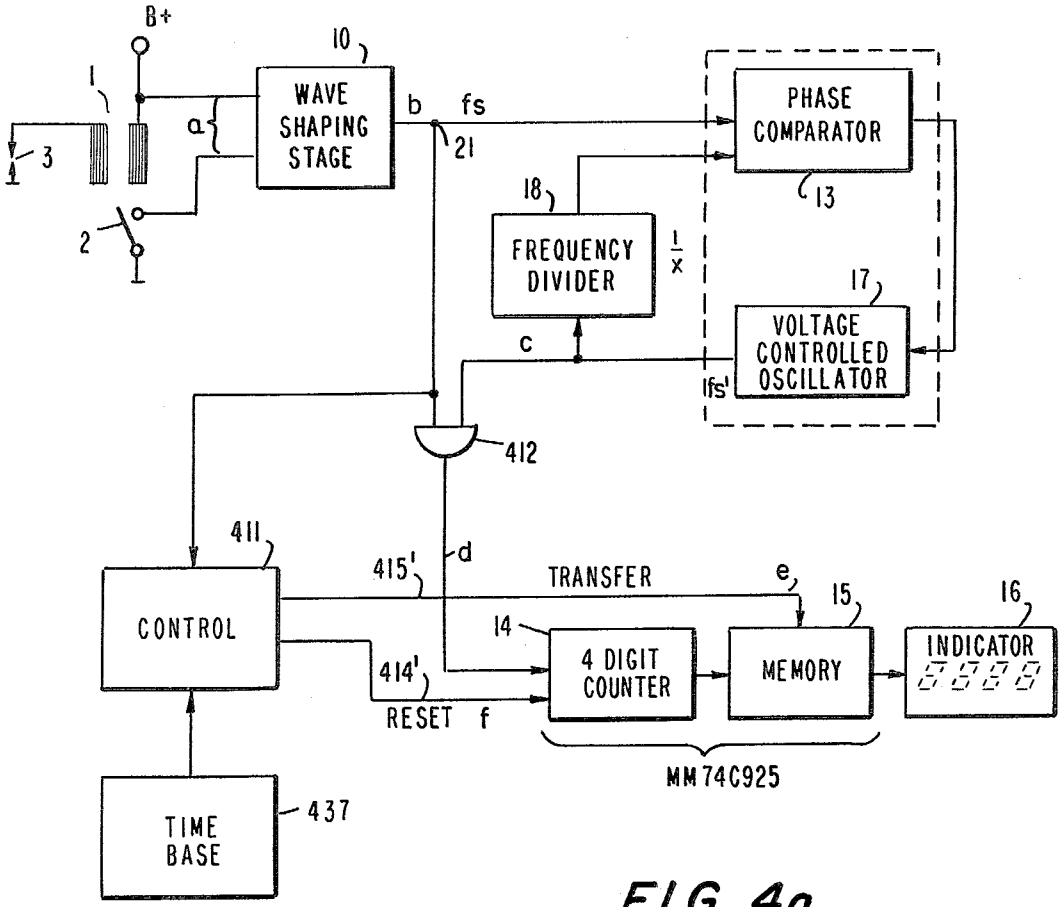

FIG. 4*a* is a diagram similar to FIG. 1, but shown drawn with the connections established by the circuit of FIG. 1 to test for dwell angle;

FIG. 4*b* is a series of graphs showing the signals which occur in the system of FIG. 4*a;*

Figure 5B:
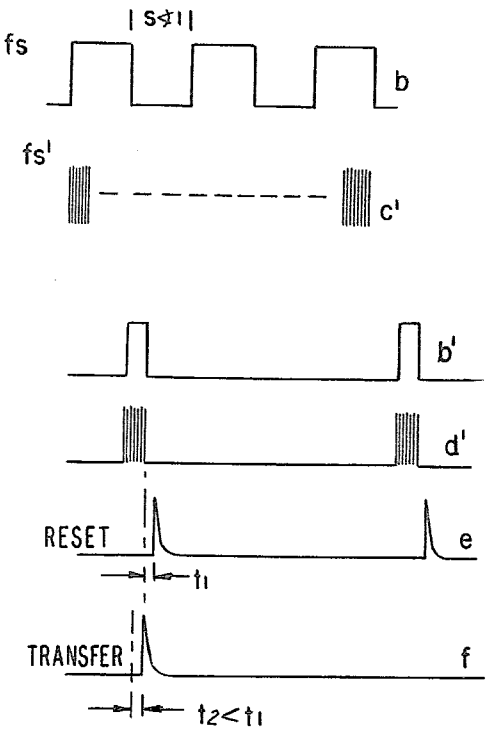
Figure 5A:
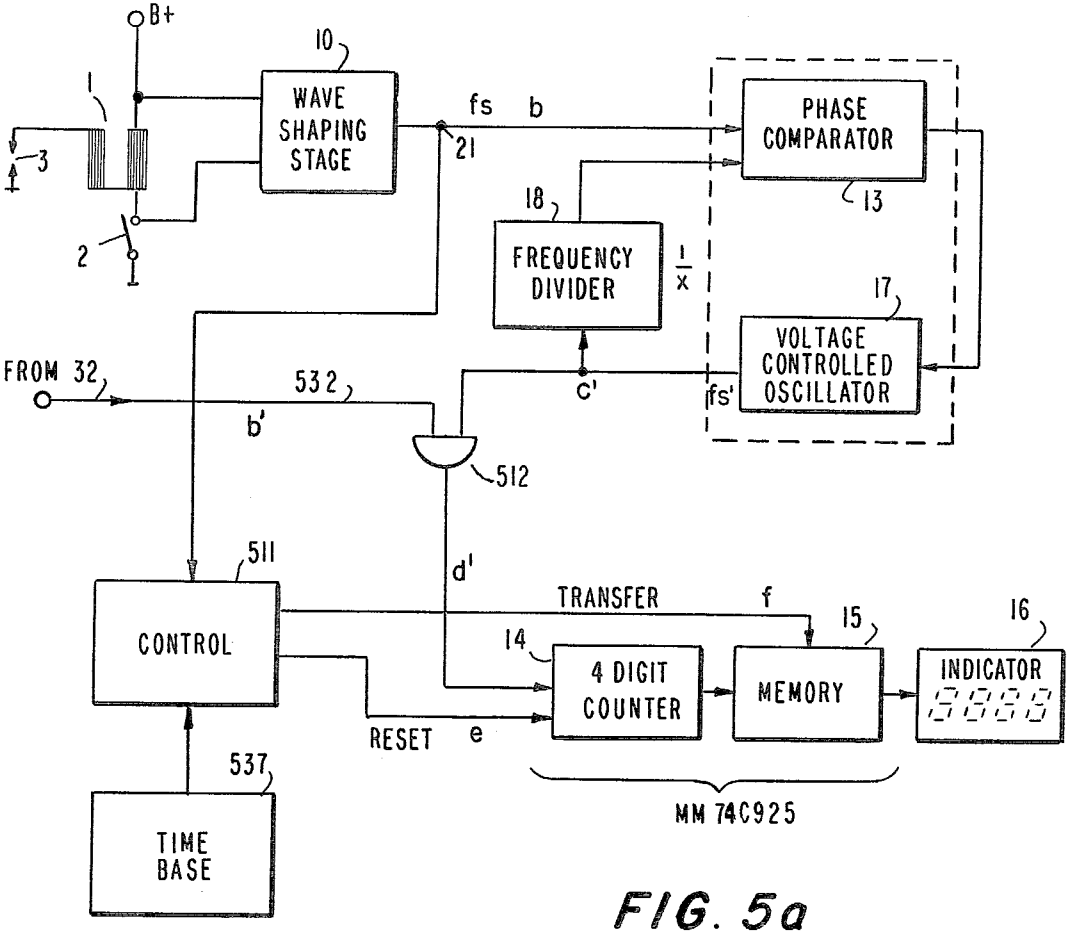

FIG. 5*a* is a diagram similar to FIG. 1, but shown drawn with the connections established by the circuit of FIG. 1 to test for ignition timing;

FIG. 5*b* is a series of graphs showing signals which occur in the system of FIG. 5*a;*

FIG. 6*a* is a diagram similar to FIG. 1, but shown drawn with the connections established by the circuit of FIG. 1 to test for engine speed;

FIG. 6*b* is a series of graphs showing signals which occur the system of FIG. 6*a;* and FIG. 6*c* is a pulse diagram of measuring and transfer pulses arising in the system.

The apparatus is used to test electrical values which occur in an internal combustion engine, typically an automotive internal combustion engine. FIG. 1 shows, schematically, an internal combustion engine E and associated electrical equipment. A battery B is provided, the operation of the engine E being controlled by an ignition system I. The ignition system I has an ignition coil 1, a breaker switch 2 and spark plugs 3. A distributor may be interposed for multi-cylinder engines, as is well known. The system is shown schematically only.

Figure 3:
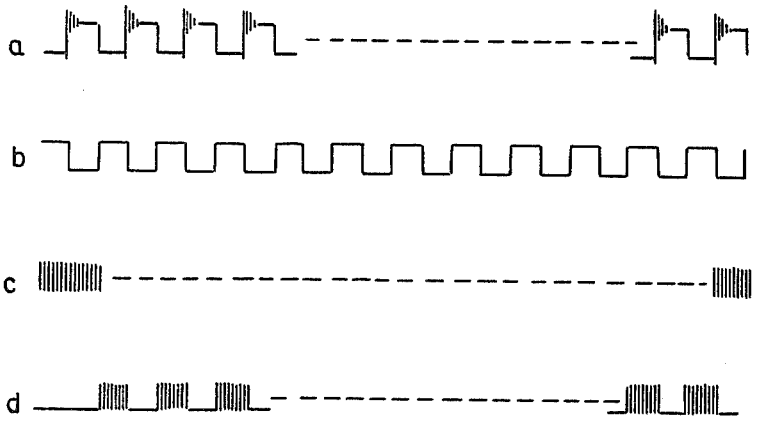
FIG. 3 is a series of graphs illustrating the basic operation of the circuit, the signals representative at lines a–d of the graph being indicated by similar letters a–d on FIG. 1.

A signal is derived, for example, directly from the primary of the ignition coil by connection across the ignition coil, and applied to a wave shaping stage 10. This signal a is shown in FIG. 3. Wave shaping stage 10 is an impulse transformer, for example a Schmitt trigger, which provides a square wave output signal shown at graph b of FIG. 3. This square wave output signal is applied to a junction or bus 21. Suitable circuits for stage 10 are shown in "Electronic Circuits Manual", edited by "Marcus" (McGraw-Hill, 1971), for example page 900, upper left. Junction 21 is connected to a control stage 11, the operation of which will be disclosed below. Stage 11 is provided to control the various operating functions of the system, to provide switching or enabling signals and timing signals to the various components. It may include suitable switches, which can be manually operated to control various functions, ganged together, camming switches, or electronic switches. A typical combined circuit showing components suitable for control stage 11 is shown in "VHF Communications", Vol. 2, June 1972, article "6-digit counter for frequencies between 1 Hz and, typically, 100 MHz," pp. 66 to 72 and 96, 97. The stage 11 provides the necessary switching function signals and control signals for coordinating the various operations which the apparatus is capable of performing.

Junction 21 is connected to a mode or test selection transfer switch 22 which has three positions—I to test for dwell angle; II to test for ignition timing; and III to test for speed. Switch 22 may be a controlled semiconductor switch, a programmed cam switch or the like, controlled manually or, if desired, from control stage 11.

The center connection of switch 22 is connected to one input of an AND gate 12. Switch 22 is additionally connected to the control stage 11 which also provides an enabling ON/OFF signal to gate 12, that is, control stage 11 can include the master switch for the entire system and, when the apparatus is turned ON, AND gate 12 is enabled.

Junction 21 is further connected to a phase locked loop (PLL) 19, and specifically to a phase comparator 13 thereof. PLL circuits are commercially available in integrated circuit form, for example as described in the above "Electronic Circuits Manual", page 1000, using a voltage controlled oscillator (VCO). A suitable integrated circuit is Solid State Scientific Inc. type SCL 4046B or SCL 4446B.

The AND-gate 12 is connected to a counting and output stage 20 which includes a counter 14, a memory 15 connected thereto and storing counts of the counter 14 and to permit averaging. An indicator 16 is connected to the memory to provide a digital numerical read-out. Counter circuits are available commercially and described under "Counters" in the above referred-to circuits manual; a suitable integrated circuit counter is National Semiconductors, Santa Clara, Calif., MM 74C927.

Indicator 16 is a standard digital display indicator to provide numerical digital output. The control stage 11, besides enabling the AND gate 12, is connected through lines 14', 15', respectively, to counter 14 and memory 15 to provide the necessary "housekeeping" signals, that is, to effect transfer of a count in counter 14 to the memory 15 and then to indicator 16, and reset of the counter 14.

The PLL 19 has the output of phase comparator 13 applied through a switch 23 to a VCO 17, the output of which is connected to an input of a frequency divider 18 which, in turn, is connected to the phase comparator 13. The output of VCO 17 is additionally connected as an input to the AND gate 12.

The frequency derived from the VCO 17 will be a high multiple of the frequency of the wave shape b at junction 21, and frequency divider 18 is provided to divide back this previous multiplication effected by the VCO so that the phase comparator 13 can function properly. The much higher frequency pulses being applied to the AND gate 12 will be counted in counter 14 for the duration that the AND gate 12 is enabled. This enabling duration is determined by the input from the common connection of switch 22, that is, when the line 22' thereto has an enabling signal for the AND gate thereon—provided, of course, that the signal is ON, as determined by the output from the control stage to the AND gate 12.

Figure 2:
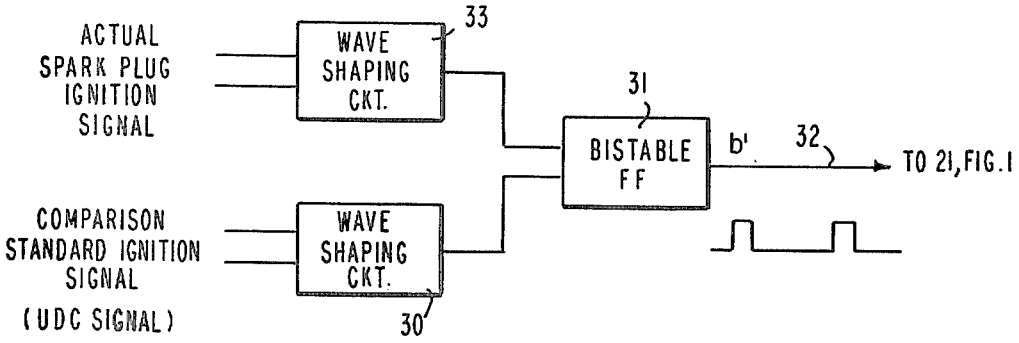
FIG. 2 is a fragmentary diagram to determine firing angle or spark advance by means of the apparatus of FIG. 1, and shows an attachment or accessory circuit for use with the circuit of FIG. 1.

If it is desired to test ignition angle, typically ignition advance, switch 22 is placed in the position II, and the circuit of FIG. 2 is used to provide the enabling signal to AND gate 12 over line 22'. The ignition advance angle is related to a fixed reference position of a piston of the IC engine E, preferably the top dead center (TDC) position of one of the pistons. The ignition advance angle is given in degrees of engine crankshaft rotation.

A wave shaping circuit 33 has an input signal applied thereto which is derived from the first spark plug, that is, which will occur at the time when the actual ignition spark occurs. This signal is used to set a bistable flip-flop (FF) 31. The FF 31 is reset by a signal derived from a wave shaping circuit 30 which provides the reset signal at the time of occurrence when the piston is in the reference position, that is, provides an output signal derived from a comparison standard ignition signal, typically the TDC signal. The TDC signal can be derived in various ways. Some motor vehicles provide a test terminal at which a TDC signal is available to permit just such a test; a timing light, using a flash lamp, can also be employed to flash when the TDC marker available at the flywheel of the engine E is at the reference position. The TDC signal, thus obtained—the occurrence of which will be coincident with the TDC position or the reference position of the reference piston in a multi-cylinder engine then is used to reset the FF 31, so that the pulse width of the output signal from the FF 31 will have a duration related to the time that the crankshaft of the engine E requires to rotate from the angular position when the spark occurred to the reference TDC position. The wave shaping circuits 30, 33 are desirable to provide signals of proper wave shape for ready processing in the FF 31. The output signal from FF 31 is available at terminal 32 and connected to switch terminal II of switch 22 (FIG. 1).

To test for speed, switch 22 is set in position III. A frequency generator 611, and providing an output frequency of, for example, 8 Hz, is connected to the terminal III. The frequency generator 611 may, physically, be part of the control stage 11, but is shown separately in FIG. 1 in view of its separate function. If part of the control stage 11, the switching of switch 22 can then also be combined with the control stage 11. The components are shown separately in FIG. 1 in view of their separate functions. Frequency generator 611 provides a stable output frequency to furnish a time base during which the counter 14 can count to a number controlled by the width of the pulses from wave shaping stage 10, so that the number of pulses—per unit time as determined by generator 611—will be counted in counter 14 and permit a direct speed indication in indicator 16.

Operation with reference to FIG. 3:

First test—dwell angle:

Switch 22 is placed in position I, and switch 23 is closed. The signal derived from the ignition coil, that is, across primary 2 thereof, is shown in line a of FIG. 3. This signal is changed in wave shaping stage 10 to the signal shown in line b of FIG. 3. The b signal is applied through switch 22 at position I over line 22' to the gate 12. The signals are present in digital form, that is, a 1-signal represents a voltage close to that of the supply potential, and a 0-signal a voltage close to zero or reference potential.

When the control stage 11 provides an enabling ON signal, AND gate 12 is enabled and the signal applied through switch 22 then is a 1-signal. The pulses derived from VCO 17, as shown in line c of FIG. 3, are also applied to the AND gate 12, and gate 12 will pass the pulses in the form shown in line d of FIG. 3, to be individually counted in counter 14. The number of pulses which are counted during any one "open" or 1 duration of the AND gate 12 will be determined by the width of the pulses b on line 22', and hence the dwell time of the signal will be accumulated, in digital form, in the counter 14. When the gate 12 opens, that is, when the line 22' goes OFF, control stage 11, through a short time delay, provides a transfer signal of the count state from counter 14 to the memory 15 over line 15' and, shortly thereafter, a reset signal over line 14' to the counter 14. Thus, the count state which the counter 14 has reached during the ON time of gate 12 is now transferred into the memory 15, and the counter reset. The state of the memory can be indicated in indicator 16 which, in the form shown, is a digital read-out device, for example of the type providing a bar representation of Arabic numerals. The control stage 11 here, as in all the sequential tests, sets up the connections between the gate 12 and the circuit which applies the signals thereto, that is, it can be used to control the switch 22 to operate in its respective operating positions I, II, III. This can be done manually, for example by manually closing enabling switches on the control stage 11, by multi-function switches within stage 11, for example by means of cams, ganged switches, by program control, or the like. Stage 11 can also, directly, be combined with switch 22, by suitable arrangement of cams, switching disks, or the like, as well known in multi-functioning switching control. Additionally, control stage 11 provides timed transfer pulses to transfer the count number from the counter 14 into the memory 15 when the signal b changes, that is, shortly after the counter 14 has stopped counting. Further, the control stage 11 provides the reset pulse for the counter 14, so that the counter 14 can start a new counting cycle when the gate 12 opens again at the next pulse b. Control and timing circuits of this type are well known. Control stage 11, in this embodiment, senses the change in the b signal and provides a slightly delayed transfer pulse on line 15' and an additionally slightly delayed reset pulse. In this embodiment, the circuit 11 has as its primary function merely the control of the counter 14 and the memory 15. The circuitry to effect this control can, simply, include a trigger sensing circuit, sensing when the b signal changes, and then providing a slightly delayed pulse directly to line 15' and from this pulse, a further slightly delayed pulse to line 14'. Such time delay circuits themselves are well known and, in their simplest form, include resistor-capacitor networks, as described in detail and shown, for example, in the above referred-to VHF Communications literature reference.

The number of pulses which will pass through AND gate 12 during any one 1-level of signal b is determined by the frequency of the output from the PLL 19.

The VCO 17 provides an output signal of a frequency shown in line c of FIG. 3, which is a multiple of the frequency $f_s$ of the signal train applied to the wave shaping stage 10, that is, the output signal $f'_s$ from the VCO is 100 $f_s$. The output frequency derived from VCO 17 is divided by the frequency divider 18 to such an extent that the frequency at the output of frequency divider 18 can be directly compared with the frequency derived from wave shaping stage 10 in phase comparator 13, that is, in the example by 100. If there is a difference in the two frequencies, the comparator 13 provides a d-c output signal which controls the VCO in such a manner that the phase difference or frequency difference sensed by comparator 13 is nulled. Thus, when the output of VCO 17, as divided by frequency divider 18, is the same as that applied from wave shaping stage 10—signal b, VCO 17 will supply a signal having a frequency which is a multiple, in the example 100 times, of the frequency of the incoming signal train. The frequency of the signal c from the VCO 17 thus will depend on the frequency of the signal b at junction 21, since the division ratio of the frequency divider 18 is fixed. The division ratio of frequency divider 18 is preferably selectable or programmable such that the pulses which are applied to the counter 14 during the open time or period of gate 12 provide a counted number which will permit direct numerical read-out at indicator 16, that is, which directly corresponds to the dimension of the desired information. In the example, this will be degrees of dwell angle (or a multiple thereof).

FIG. 4, collectively, illustrates the circuit of FIG. 1 when the switches are in the position as described, and to determine dwell angle with the PLL. FIG. **4*b* illustrates the wave forms to enlarged scale, which provides an output of the dwell angle in percent. Curves e and f illustrate the reset and transfer signals on lines 414', 415', respectively. The AND gate 412 has the function of passing the signals c in intermittent blocks to form the signal d and apply it to the counter 14 which, preferably, is a 4-digit counter. Control unit 411 has a time base generator 437 connected thereto, which time base generator preferably is quartz-controlled in order to permit accurate timing. The time base generator is not actually used in this embodiment, but necessary if speed is to be measured, as will be discussed below. It is shown on FIG. 4*a*** for completeness since it is a desirable feature in the entire apparatus.

The pulses provided by the control stage 411 to transfer the count in counter 14 to the memory 15 and to then reset the counter 14 are shown in lines e and f, where the time delays $t_1$ and $t_2$ are also indicated.

When determining the dwell angle, it is difficult to obtain read-out from the indicator 16 at any one determination since use of a single pulse to determine dwell angle is not suitable for most internal combustion engines, since the dwell angle may vary too much to provide meaningful digital read-out. The variation may well be ±2% with respect to an average. The memory and indicator 15, 16 are thus used to form an average.

This can be readily done in this manner: Five consecutive dwell angle pulses are added digitally, using a resolution of ½%—that is, 200 individual pulses per period or cycle. In the memory, the output is then divided by 10, by shifting the comma by one position to the left.

The memory 15 is preferably fixed-wired to effect this average formation and division by 10, by shifting the comma. This additional circuit to add the pulses at a rate of 200 pulses per cycle, and subsequent division, within the memory—circuits which, by themselves, are well known in digital technology—is enabled when the control unit 411 (FIG. 1) places the apparatus in the dwell angle determination mode, as specifically indicated in FIG. *4a*. The unit 411, then, will include an additional control line to the counting and output stage 20—not shown for simplicity—to effect signal processing within the stage 20 to provide for averaging of a number of count values.

Other averaging systems may be used, for example addition of the output directly received from the counter 14 in the memory 15, for example adding ten outputs, and then transferring the result to the indicator 16, with the decimal point again shifted by one position to automatically effect division by 10. Addition in a digital memory, rather than immediate display, is a well known function of digital circuits.

Test 2, firing angle, with reference to FIGS. *5a, 5b:* Switch 22, FIG. 1, is placed into the II position. The resulting circuit is shown in FIG. *5a*. The circuit of FIG. 2 is connected to AND gate 12 by connection of line 32 through switch 22 in position II. In FIG. 5, line 32 has been given the denotation 532, and is connected to line 32, FIG. 2, so that AND gate 512 is enabled to pass pulses c′ whenever a signal b′ is derived from FF 31 (FIG. 2). The output signal b′ derived from FIG. 2 corresponds functionally to the signal b described in FIG. 1, that is, it controls the open time of AND gate 12, or 512, respectively, and hence the number of pulses from PLL 19 which can be counted in counter 14, stored in memory 15 and indicated in indicator 16.

The signal b′ is derived as follows: The output signal of the wave shaping circuit 33 sets the FF 31; wave shaping circuit 30 resets FF 31. The SET pulses should always occur in advance of the corresponding RESET pulses from circuit 30. These RESET pulses are derived either from a fixed pulse source associated with the vehicle to be tested, from a timing light test lamp, or from another signal source which can be associated with the engine and indicative of TDC position of a reference piston. When using a pistol-type timing light with a strobe flash lamp, for example, a monostable multivibrator is triggered by ignition pulses. The trailing flank of the monoflop connects the timing light to flash. The timing period of the monoflop then is changed until the timing light, directed to the TDC marker on the flywheel of the engine switches ON just when the marker appears. The timing light, thus, will provide a reference signal representative of TDC position to control the RESET of FF 30. This is standard practice to determine the TDC position, and known to any mechanic.

Control stage 511 now has as its primary and essentially only function the generation of the transfer pulse f and the reset pulse e to transfer the count in counter 14 to the memory 15 for subsequent indication on indicator 16. The control stage 11 may, additionally, include a control output to the indicator 16 so that the indicator will read, directly, in degrees of crankshaft rotation, by enabling a fixed-wired program which converts the number of pulses derived from memory 15 to the number of pulses needed to furnish the just defined output at indicator 16. Such conversion circuits are well known, and used, for example, in fixed program conversions between British and metric measuring systems.

To be able to test for spark retardation beyond TDC position, and still use only a 4-digit counter for unit 14, it may be necessary to shift the reference or zero point of the counter with respect to TDC position by a predetermined value, that is, to cause the counter to provide an output which is representative of a value other than that actually being counted by introducing a constant therein. For some tests it may be necessary to advance the reference point, for others to retard the reference point. The counter 14, preferably, is a bi-directional counter. If the reference signal is advanced by a predetermined fixed value, a correspondingly fixed value can be set into the counter from which the counter can then count down or backwardly. This control can also be part of the control unit 511, which enables a suitable control line (not shown for simplicity) between the control unit 511 and the counter, upon setting the control unit in the firing angle test mode, for example by closing a suitable switch providing an enabling signal to a presetting circuit in counter 14. Control stage 511 can be programmed to set one or more predetermined values in the counter 14 if a shift of reference from TDC position is desired, for example under control of a separate switch which provides a suitable setting signal to the counter 14. Such a switch may be in the nature of a range switch of the test instrument.

The divider 18 of the PLL preferably is a programmed divider, permitting the use of different division ratios. A suitable number of pulses $s'_s$, corresponding to the signal c′, is about 360 pulses per revolution, corresponding to a 360° or total revolution of the crankshaft. The indication from indicator 16, then, will read directly in spark advance by degrees of crankshaft rotation. Averaging, again, can be done as described in connection with FIG. *4a*.

Third test—speed: The circuit of FIG. 1 is used; switch 22 is in the III position. Because speed is a function of time, a time base circuit is required, formed by frequency generator 611 which, physically, can be part of the control stage 11. The frequency generator 611 puts out a time base signal which enables AND gate 12 to pass a number of pulses from the PLL 19 which depends on the revolutions of the engine, the frequency generator 611 then establishing the time units during which the number of pulses from the PLL 19 are counted.

In a preferred form, the frequency generator 611 is included within control stage 11, and is programmed to provide an output signal to open gate 12 for predetermined time periods. During those time periods, a frequency derived from VCO 17, which is dependent on engine speed, will be applied to the counter 14. Due to the division ratio of frequency divider 18, the frequency of VCO 17 will be so set that the counter state which is transferred to indicator 16 through memory 15 can be used for a direct display of speed in, for example, revolutions per minute. The circuit which will be established by the setting of the switch 22 in the III position is shown in abbreviated form in FIG. 6.

The control unit 611′ of FIG. 6 incorporates the time base frequency generator 611, so that the output from the control unit will not only be the "housekeeping"

transfer and reset signals e, f, explained above, but additionally the signal b'' to enable the AND gate 612 to provide sequential pulse trains d which can be counted in counter 14. The control unit 611', which may include a frequency divider, provides pulses b'' of, for example, one-half of 8 Hz, that is, of a duration of 62.5 milliseconds (16 Hz). The frequency divider 18 which is preferably a programmed frequency divider is controlled by the control unit 611' through a suitable line, not shown (or by an individual manual setting) to provide a frequency division 1/x in which the number x will depend on the number of cylinders of the engine, so that the number of pulses c'' per unit time can be matched to the pulses b'' which open the AND gate 612 to permit counting in counter 14 at a rate which then will enable indication at indicator 16 directly in rpm. A suitable measuring time period is ½ of 8 Hz, and a suitable sampling rate of the indicator 16 is about 4 Hz.

FIG. *6c* shows two groups of curves corresponding to graphs b'' and e and f, respectively. The time base which provides the measuring period is shown at b-8, for example on the basis of 8 Hz, corresponding to pulse b''. The counter will be reset at the end of each count period, as shown in graph e-8. The measuring period to be indicated, as stored and added in the memory 15, is at a rate of 4 Hz, as shown by graph b-4, and the transfer pulse which transfers the count stage from the memory 15 to the indicator 16 is shown at the graph f-4, showing an accumulation of two count periods.

A quartz generator to establish time basis, inherently, is well known, and may be formed as a integrated circuit with a 32768 Hz quartz crystal connected to a 4060 quartz generator which provides an output at 8 Hz, divided, for example, in an FF 4013 to provide a 4 Hz time base for the control unit 611'.

The transfer signal f can be used not only to transfer the state of the counter into the memory 15 but also to transfer the count stored, and accumulated in the memory 15 to the indicator 16 at suitable times. Again, the respective transfer signals to transfer the counter state to the memory, and the memory store to the indicator, can be generated in the respective control unit 11, 411, 511, 611', by suitably delaying a trigger pulse derived from the trailing flank of the signal which controls the respective AND gate 12, 412, 512, 612, or a signal derived therefrom, as clearly shown in the graphs of FIG. *6c*.

SCL 4013B, SCL 4060AB delivered by Solid State Scientific Inc.

Fourth Test—voltage: The apparatus can be used to test for voltage levels independently of any operating conditions of the engine. Under those test conditions, the switch 23 which closes the PLL 19 will be opened so that the output voltage of the VCO will be a frequency representative of the voltage being tested. Control switch 22 is left in the position III to provide a fixed time base to the counter 14 during which pulses are accumulated in the counter 14, the number of pulses depending on the level of the test voltage applied at terminal 24 which controls the frequency of the VCO 17. The frequency generator 611 can then be set in such a manner that the number of pulses provided by VCO 17 during any one test interval, as determined by the frequency generator 611, will be directly representative of the voltage level at terminal 24, or a readily allocatable multiple thereof, for example 10 to 100 times, which can be directly indicated on indicator 16 by suitable positioning of a decimal point.

The wave shaping stage 10 is not used or needed. Control stage 11 will then merely provide the enabling output signal to gate 12. Application of a d-c voltage to terminal 24, forming a test voltage input, and for example to test the voltage of the battery B, will control the frequency of the VCO to provide an output voltage directly representative of the test voltage. By suitably selecting the timing intervals derived from control stage 11, that is, from the frequency generator 611 which, preferably, forms a part thereof, the number of pulses counted by counter 14 and then transferred through memory 15 to the indicator 16 can be made directly proportional to the applied test voltage.

The PLL 19 is available in integrated circuit form as a commercial article of trade, e.g. SCL 4046B or SCL 4446B; a combination counting-memory and indicator driver stage is available as a commercial integrated circuit as MM 74C927 which inherently includes a division by six, rather than by ten, so that an output reading in tenths of seconds and minutes with decimal input can be obtained.

Various changes and modifications may be made within the scope of the inventive concept.

I claim:

1. Internal combustion engine ignition test system comprising means (10) generating a signal train (b) derived from the primary or low-voltage portion of the ignition system of the engine;

a conjunctive gate (12);

a frequency multiplier (19) connected to and controlled by said signal train and providing a sequence of output pulses (c) having a pulse repetition rate which is a multiple of the frequency of said signal train, said multiple sequence being applied to said conjunctive gate (12) to an input thereof;

means (21; 30–33; 611, 24) generating an enabling pulse train representative of a parameter to be tested;

means (22) applying the pulses of said pulse train to another terminal of said conjunctive gate (12) to pass a plurality of said output pulses through said gate in dependence on the other of the pulses of said enabling pulse train;

a counting and output stage (20) connected to and controlled by said conjunctive gate (12) and including a counter (14) counting the number of output pulses delivered from said gate during any one pulse of said enabling pulse train;

and a digitial indicator (16) providing a digital display of said counted number.

2. System according to claim 1, wherein said means applying said signals of said train includes a wave shaping stage (10).

3. System according to claim 1, wherein said frequency multiplier comprises a phase locked loop (19).

4. System according to claim 1, wherein the multiplication factor of said frequency multiplier is selected with respect to the width of the pulses of said enabling pulse train to provide an output display of said digital indicator (16) which is directly readable in desired units characterizing the parameter on the test.

5. System according to claim 4, wherein (FIG. 4) the means (22) applying the pulses of said enabling pulse train to said gate (12) are connected to the ingition coil (I) of the internal combustion engine and representative of the closing time of the breaker circuit (2) thereof, whereby the output indication of the indicator (16) will be representative of dwell angle of the ignition breaker circuit of the engine.

6. System according to claim 1, wherein (FIGS. 2 and 5) the engine is a piston engine;

the means generating the enabling pulse train comprising means (30) providing a standard signal characteristic of a predetermined position (TDC) of a piston of the engine;

and means (31) comparing the time of occurrence of said standard signal and an actual ignition signal and providing said enabling pulse train, in which each pulse has a width representative of the firing angle or spark advance of the piston, whereby the output indication of the indicator (16) will be representative of spark timing of the engine.

7. System according to claim 6, wherein the counter (14) is an up-down counter.

8. System according to claim 7, including means (11) to preset the counter to a predetermined number, said counter counting down from said number.

9. System according to claim 1, wherein (FIG. 6) the means generating the enabling pulse train includes a time base generator (611) providing enabling timing pulses of a predetermined time interval, whereby the output indication of the indicator (16) will be representative of speed of the engine.

10. System according to claim 1, wherein the frequency multiplier includes a phase locked loop having a voltage controlled oscillator (17), a frequency divider (18) and a phase comparator (13), the phase comparator being connected to and controlled by said signal train.

11. System according to claim 10, further comprising (FIG. 6) switch means (23) interrupting the closed loop circuit of the phase locked loop (19); means (24) connecting a test voltage to the voltage controlled oscillator to generate output pulses at a rate controlled by said voltage;

and the means generating the enabling pulse train includes a time base generator (611) providing enabling pulses of a predetermined time interval, whereby the output indication of the indicator (16) will be representative of the output voltage applied to said test voltage connecting means (24).

12. System according to claim 1, wherein the system is a testing system to provide for testing of at least one of: dwell angle; firing angle;

and wherein the means applying the pulses of said train comprises a multi-position (I, II, III) switch means (22, 23), and wherein (a) to test for dwell angle, the switch means in a first position (I), connects the means (10 ) generating the signal to said conjunctive gate (12, 412);

(b) to test for firing angle, a standard signal having a standard relationship to a predetermined angular position (TDC) of a piston of the engine is provided, means (33) furnishing an actual ignition event signal are provided, and means (31) comparing said actual ignition event signal with said standard signal and providing a timing output signal (b') representative of the different in timing, and, when the switch means (22) is in a second position (II), connecting said timing output signal to said conjunctive gate (12, 512).

13. System according to claim 12, to provide, selectively, additionally for test of engine speed, wherein a time base generator (611) is provided, and the switch means, in a third position (III), connects the time base generator to said conjunctive gate (12, 612).

14. System according to claim 13, to provide, selectively, additionally for test of a voltage level wherein the frequency multiplier comprises a phase locked loop (PLL-19) including a voltage controlled oscillator (17) controlled by said test voltage;

said switch means connects the time base to the conjunctive gate for a predetermined period of time, and the generator (611) to said conjunctive gate, disconnects said signal train from the frequency multiplier and instead connects the voltage controlled oscillator.

15. System according to claim 13, further including a memory (15) connected between the counter (14) and said indicator (16).

16. System according to claim 13, wherein the frequency multiplier includes a phase locked loop having a voltage controlled oscillator (17), a frequency divider (18) and a phase comparator (13), the phase comparator being connected to and controlled by said signal train.

17. System according to claim 16, wherein the frequency divider (18) has a controllable division ratio.

18. System according to claim 13, including means (11) to preset the counter (14) to a predetermined number.

* * * * *